US009334083B2

(12) United States Patent
Joung

(10) Patent No.: US 9,334,083 B2
(45) Date of Patent: May 10, 2016

(54) CARGO SUPPORT USING WOOD POLYMER/PLASTIC COMPOSITE MATERIAL

(71) Applicant: LG HAUSYS, LTD., Seoul (KR)

(72) Inventor: Jae Youl Joung, Daejeon (KR)

(73) Assignee: LG Hausys, Ltd., Seoul (KR)

( * ) Notice: Subject to any disclaimer, the term of this patent is extended or adjusted under 35 U.S.C. 154(b) by 0 days.

(21) Appl. No.: 14/423,663

(22) PCT Filed: Sep. 4, 2013

(86) PCT No.: PCT/KR2013/007981

§ 371 (c)(1),
(2) Date: Feb. 24, 2015

(87) PCT Pub. No.: WO2014/038848

PCT Pub. Date: Mar. 13, 2014

(65) Prior Publication Data

US 2015/0321792 A1 Nov. 12, 2015

(30) Foreign Application Priority Data

Sep. 6, 2012 (KR) ..... 10-2012-0098600

(51) Int. Cl.
*B32B 3/00* (2006.01)
*B32B 3/20* (2006.01)
(Continued)

(52) U.S. Cl.
CPC ..... 2519/00019 (2013.01); *B65D 2519/00024* (2013.01); *B65D 2519/00029* (2013.01); *B65D 2519/00034* (2013.01); *B65D 2519/00039* (2013.01); *B65D 2519/00054* (2013.01); *B65D 2519/00059* (2013.01); *B65D 2519/00064* (2013.01); *B65D 2519/00069* (2013.01); *B65D 2519/00074* (2013.01); *B65D 2519/00089* (2013.01); *B65D 2519/00094* (2013.01); *B65D 2519/00099* (2013.01); *B65D 2519/00104* (2013.01); *B65D 2519/00109* (2013.01); *B65D 2519/00273* (2013.01); *B65D 2519/00278* *B65D 19/38* (2013.01); *B65D 19/0004* (2013.01); *B65D 19/0095* (2013.01); *B65D*
(Continued)

(58) Field of Classification Search
CPC ..... B65D 19/00; B65D 19/14; B65D 19/18; B65D 2519/00029; B65D 2519/00064; B65D 19/38; B65D 19/0004; B65D 2519/00074; B65D 2519/00796; B65D 2519/00039; B32B 21/04; B32B 21/13; B32B 21/042; B32B 21/08
USPC ..... 428/166, 188, 537.1, 535; 108/51.3, 108/52.1, 57.12; 524/13
See application file for complete search history.

(56) References Cited

U.S. PATENT DOCUMENTS

2003/0024443 A1* 2/2003 Hoshi ..... B29C 43/003 108/51.11
2010/0229764 A1 9/2010 Ingham
2010/0310893 A1* 12/2010 Derbyshire ..... B32B 21/02 428/528

FOREIGN PATENT DOCUMENTS

CN 2573198 Y 9/2003
CN 201406085 Y 2/2010
(Continued)

*Primary Examiner* — Catherine A Simone
(74) *Attorney, Agent, or Firm* — Dentons US LLP

(57) ABSTRACT

A cargo support includes an upper panel having a freight loaded on; a lower panel associated with the upper panel via a plurality of spacers to have the upper panel separated from the ground at a predetermined height; and a plurality of insert openings, each provided between the adjacent spacers associated with each other in the horizontal direction and separated from each other at a predetermined distance to have a fork inserted thereinto, where the upper and lower panels includes a wood polymer/plastic composite material prepared by using wood flake chips as a principal ingredient.

10 Claims, 1 Drawing Sheet

(51) Int. Cl.
*B65D 19/38* (2006.01)
*B65D 19/00* (2006.01)

(52) U.S. Cl.
CPC ..... (2013.01); *B65D 2519/00293* (2013.01); *B65D 2519/00298* (2013.01); *B65D 2519/00323* (2013.01); *B65D 2519/00333* (2013.01); *B65D 2519/00353* (2013.01); *B65D 2519/00373* (2013.01); *B65D 2519/00796* (2013.01)

(56) References Cited

FOREIGN PATENT DOCUMENTS

| | | | | |
|---|---|---|---|---|
| EP | 1086988 | | 3/2001 | |
| GB | EP 0326239 | A1 * | 8/1989 | ..... B65D 19/0038 |
| JP | 50150780 | | 12/1975 | |
| JP | 7171808 | A | 7/1995 | |
| JP | 2001260108 | A | 9/2001 | |
| JP | 2002302120 | | 10/2002 | |
| JP | 2003260702 | | 9/2003 | |
| JP | 2004174721 | A | 6/2004 | |
| JP | 200588460 | A | 4/2005 | |
| JP | 2008143014 | A | 6/2008 | |
| JP | 201261868 | A | 3/2012 | |
| KR | 2019980055974 | | 10/1998 | |
| KR | 1020030005106 | | 1/2003 | |
| KR | 1020030005106 | A | 1/2003 | |
| KR | 200325851 | | 9/2003 | |
| KR | 200348937 | | 4/2004 | |
| KR | 200356715 | | 7/2004 | |
| KR | 1020070001775 | | 1/2007 | |
| KR | 1020090119257 | | 11/2009 | |
| KR | 1020100117493 | | 11/2010 | |
| WO | 2012074230 | A2 | 6/2012 | |

* cited by examiner

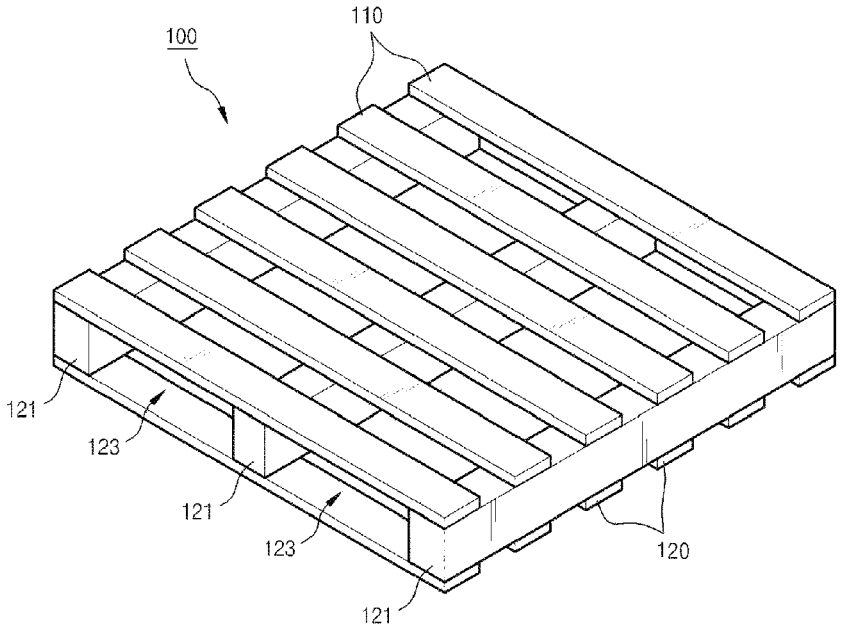
100
110
121
123
121
123
121
120

CARGO SUPPORT USING WOOD POLYMER/PLASTIC COMPOSITE MATERIAL

This application is a National Stage Entry of International Application No. PCT/KR2013/007981, filed Sep. 4, 2013, and claims the benefit of Korean Application No. 10-2012-0098600, filed on Sep. 6, 2012, all of which are hereby incorporated by reference in their entirety for all purposes as if fully set forth herein.

BACKGROUND OF THE INVENTION

1. Field of the Invention

The present invention relates to a cargo support and, more particularly, to a cargo support using wood polymer/plastic composite material that is molded from wood flake chips in place of wood flour to achieve high strength.

2. Background Art

Generally, a cargo support is provided to convey freights in the unit of a defined load. The cargo support has a rectangular panel on which freights are loaded, with insert openings formed from side to side or from front to back for the fork of a forklift to be inserted into the panel. The cargo support of this structure is designed to convey freights loaded on the top of the panel and lifted on the panel with the fork of a forklift inserted into the insert opening formed on the one side. The cargo support is widely used as a means for moving a relatively bulky and heavy-weighted load of freights. Such a conventional cargo support is primarily made of a plastic material or a waste wood material.

The cargo support made of a waste wood material is, however, easy to break under a load of heavy-weighted freights. The cargo support made of a plastic material is also problematic in that it cannot satisfy the buyers' requests for a variety of standard requirements.

SUMMARY OF THE INVENTION

The present invention is derived to solve the problem with the prior art, and its object is to provide a cargo support prepared by using a wood polymer/plastic composite material that uses wood flake chips in place of wood flour to achieve high strength and secure a reduced thickness of the cargo support with a same level of strength required, thereby attaining a position of advantage in terms of production cost.

To achieve the object of the present invention, there is provided a cargo support using a wood polymer/plastic composite material according to the present invention that includes: an upper panel 110 having a freight loaded on; a lower panel 120 associated with the upper panel 110 via a plurality of spacers 121 to have the upper panel 110 separated from the ground at a predetermined height; and a plurality of insert openings 123, each provided between the adjacent spacers 121 associated with each other in the horizontal direction and separated from each other at a predetermined distance to have a fork inserted thereinto. The upper and lower panels 110 and 120 include a wood polymer/plastic composite material prepared by using wood flake chips as a principal ingredient.

In this regard, the wood polymer/plastic composite material may be prepared, by molding, using a compound including 10 to 90 parts by weight of wood flake chips and 10 to 50 parts by weight of a polymer resin, where the polymer resin includes at least one selected from the group consisting of PP, PE, PVC, ABS, PS, PC and PMMA.

The compound may further include long fibers.

The compound may include additives including 0.1 to 50 parts by weight of a compatibilizer, 0.1 to 50 parts by weight of a filler, 0.1 to 30 parts by weight of an antioxidizer, 0.1 to 30 parts by weight of a lubricant, and 0.1 to 30 parts by weight of a pigment.

Further, the wood flake chips may be cut to a length of 0.3 to 18 cm.

Further, the long fibers may include at least one selected from the group consisting of natural fibers, including corn fiber, coconut fiber, palm tree fiber, reed, bamboo, rice straw, cotton, bast fiber, wool, or silk; reinforced polymer fibers, including glass fiber, carbon fiber, or nylon; and steel wire.

The long fibers may be cut to a length of 0.3 to 18 cm.

Further, the compound optionally may include at least one recycled material selected from the group consisting of recycled paper, recycled resin, and recycled wood.

Further, the compound may be molded into the wood polymer/plastic composite material through any one of extrusion, injection or press molding.

The present invention according to the above-described construction can achieve high strength by preparing a cargo support from a wood polymer/plastic composite material by molding using wood flake chips in place of wood flour. In other words, at the same level of strength required, the cargo support can be reduced in thickness when prepared by using wood flake chips rather than wood flour, thereby securing a position of advantage in terms of production cost.

In some cases, high strength can be maximized by adding natural long fibers and/or reinforced fibers, such as glass fiber, carbon fiber, nylon, etc.

In addition, as an approach to eco-friendly products, the cargo support can be recycled by selectively using recycled paper, recycled resin, or recycled wood, to reduce environmental contaminations.

BRIEF DESCRIPTION OF THE ACCOMPANYING DRAWING

FIG. 1 is a perspective view showing a look of the cargo support using a wood polymer/plastic composite material according to the present invention.

DESCRIPTION OF REFERENCE NUMERALS OF PRINCIPAL ELEMENTS IN THE DRAWINGS

100: cargo support
110: upper panel
120: lower panel
121: spacer
123: insert opening

DETAILED DESCRIPTION OF THE PREFERRED EMBODIMENT

Hereinafter, a detailed description will be given as to the construction and function of the preferred embodiments of the present invention with reference to the accompanying drawing.

FIG. 1 is a perspective view showing a look of the cargo support using a wood polymer/plastic composite material according to the present invention.

Referring to FIG. 1, the cargo support using a wood polymer/plastic composite material according to one embodiment of the present invention includes: an upper panel 110 having a freight loaded on; a lower panel 120 associated with the upper panel 110 via a plurality of spacers 121 to have the upper panel 110 separated from the ground at a predetermined height; and a plurality of insert openings 123, each provided between the adjacent spacers 121 associated with each other in the horizontal direction and separated from each other at a predetermined distance to have a fork inserted thereinto. The upper and lower panels 110 and 120 include a wood polymer/plastic composite material prepared by using wood flake chips as a principal ingredient.

Preferably, the wood polymer/plastic composite material (WPC) is prepared, by molding, using a compound including 10 to 90 parts by weight of wood flake chips and 10 to 50 parts by weight of a polymer resin, where the polymer resin includes at least one selected from the group consisting of PP, PE, PVC, ABS, PS, PC and PMMA.

In this case, the wood flake chips are cut to a length of 0.3 to 18 cm. When the wood flake chips are cut to a length of less than 0.3 cm, it makes no difference from the case of using wood flour as a principal ingredient as in the prior art, with no effect of enhancing the physical properties such as compression strength or impact strength. Contrarily, when the wood flake chips are cut to a length of greater than 18 cm, there is a difficulty of mixing the wood flake chips with the polymer resin and performing the molding process. More preferably, the wood flake chips are cut to a length of 3 to 8 cm. The wood flake chips cut to a length within the above-defined range leads to high enhancement of the physical properties such as compression strength or impact strength and best facilitates their compatibility with other ingredients and the molding process.

In addition, the compound may further include 10 to 90 parts by weight of long fibers. Optionally, the compound may further include 10 to 90 parts by weight of the wood flake chips and the long fibers in all. More preferably, the compound may further include 50 to 90 parts by weight of the wood flake chips and the long fibers in all.

Preferably, the long fibers may include at least one selected from the group consisting of natural fibers, including corn fiber, coconut fiber, palm tree fiber, reed, bamboo, rice straw, cotton, bast fiber, wool, or silk; reinforced polymer fibers, including glass fiber, carbon fiber, or nylon; and steel wire.

The long fibers are preferably cut to a length of 0.3 to 18 cm. When the long fibers are cut to a length of less than 0.3 cm, it makes no difference from the case of using wood flour as a principal ingredient as in the prior art, with no effect of enhancing the physical properties such as compression strength or impact strength. Contrarily, when the long fibers chips are cut to a length of greater than 18 cm, there is a difficulty of mixing the long fibers with the polymer resin and performing the molding process. However, the long fibers can be molded without any limit in their length out of the above-defined range only when they are molded in parallel in the lengthwise direction of the wood polymer/plastic composite material during the extrusion molding process which is used as the molding method for the wood polymer/plastic composite material.

The formability of the wood polymer/plastic composite material becomes higher with the lower water content of the wood flake chips or the long fibers. It is, for example, preferable to perform a defined drying process in order to maintain the water content of the wood flake chips and the long fibers in the range of 5 to 15 parts by weight. More specifically, the wood flake chips and the long fibers are subjected to a drying process so that they are dried in a drier at 80 to 120° C. to have a water content of 5 to 15 parts by weight. The drying temperature for the wood flake chips and the long fibers lower than 80° C. makes it take too much time in drying the wood flake chips and the long fibers, while the drying temperature above 120° C. leads to rapid drying to warp the dense tissue of the wood flake chips, which phenomenon is called "deformation".

In this manner, the wood flake chips and the long fibers are dried to maintain the water content of 5 to 15 parts by weight, in which case they can be mixed well with other ingredients without a separate binder. Contrarily, the water content above 15 parts by weight ends up with the water in the wood flake chips vaporized during the manufacture of the wood polymer/plastic composite material to leave air bubbles that weaken the binding strength of the ingredients in the mixing step. This leads to defective products.

Further, the compound may optionally include additives. In this regard, the additives may preferably include 0.1 to 50 parts by weight of a compatibilizer, 0.1 to 50 parts by weight of a filler, 0.1 to 30 parts by weight of an antioxidizer, 0.1 to 30 parts by weight of a lubricant, and 0.1 to 30 parts by weight of a pigment.

Further, the compound may include at least one recycled material selected from the group consisting of recycled paper, recycled resin, and recycled wood.

The compound of such a composition to manufacture a wood polymer/plastic composite material may be molded into a wood polymer/plastic composite material by using any one of extrusion, injection, or press molding. The wood polymer/plastic composite material is molded into the upper panel 110, the lower panel 120, and the spacers 121, which are assembled into the cargo support 100.

The cargo support using the wood polymer/plastic composite material with such a construction according to the present invention is prepared, by molding, from the wood polymer/plastic composite material that uses wood flake chips rather than wood flour, thereby achieving high strength. In other words, at the same level of strength required, the wood polymer/plastic composite material using wood flake chips leads to production of a cargo support with less thickness and thereby attains a position of advantage in terms of production cost, when compared with the wood polymer/plastic composite material using wood floor.

In some cases, high strength can be maximized by adding natural long fibers and/or reinforced fibers, such as glass fiber, carbon fiber, nylon, etc.

In addition, as an approach to eco-friendly products, the cargo support can be recycled by selectively using recycled paper, recycled resin, or recycled wood, to reduce environmental contaminations.

The above description of the present disclosure is provided for the purpose of illustration, and the above-described embodiments do not limit the present disclosure. It would be understood by those skilled in the art that various changes and modifications may be made without changing technical conception of the present disclosure.

What is claimed is:

1. A cargo support using a wood polymer/plastic composite material comprising:

an upper panel having a freight loaded on;

a lower panel associated with the upper panel via a plurality of spacers to have the upper panel separated from the ground at a predetermined height; and a plurality of insert openings, each provided between the adjacent spacers associated with each other in the horizontal direction and separated from each other at a predetermined distance that a fork can be inserted thereinto, wherein the upper and lower panels comprise a wood polymer/plastic composite material prepared by using wood flake chips as a principal ingredient, wherein the wood polymer/plastic composite material is molded from a compound comprising 10 to 90 parts by weight of wood flake chips, 10 to 50 parts by weight of a polymer resin and long fibers, wherein the wood flake chips and the long fibers are included in an amount of 10 to 90 parts by weight.

2. The cargo support using a wood polymer/plastic composite material as claimed in claim 1, wherein the polymer resin comprises at least one selected from the group consisting of PP, PE, PVC, ABS, PS, PC and PMMA.

3. The cargo support using a wood polymer/plastic composite material as claimed in claim 1, wherein, in the compound, the wood flake chips and the long fibers are included in an amount of 50 to 90 parts by weight.

4. The cargo support using a wood polymer/plastic composite material as claimed in claim 1, wherein the compound optionally comprises additives including 0.1 to 50 parts by weight of a compatibilizer, 0.1 to 50 parts by weight of a filler, 0.1 to 30 parts by weight of an antioxidizer, 0.1 to 30 parts by weight of a lubricant, and 0.1 to 30 parts by weight of a pigment.

5. The cargo support using a wood polymer/plastic composite material as claimed in claim 1, wherein the wood flake chips are cut to a length of 0.3 to 18 cm.

6. The cargo support using a wood polymer/plastic composite material as claimed in claim 1, wherein the wood flake chips are cut to a length of 3 to 8 cm.

7. The cargo support using a wood polymer/plastic composite material as claimed in claim 1, wherein the long fibers comprise at least one selected from the group consisting of natural fibers, including corn fiber, coconut fiber, palm tree fiber, reed, bamboo, rice straw, cotton, bast fiber, wool, or silk; reinforced polymer fibers, including glass fiber, carbon fiber, or nylon; and steel wire.

8. The cargo support using a wood polymer/plastic composite material as claimed in claim 7, wherein the long fibers are cut to a length of 0.3 to 18 cm.

9. The cargo support using a wood polymer/plastic composite material as claimed in claim 1, wherein the compound optionally comprises at least one recycled material selected from the group consisting of recycled paper, recycled resin, and recycled wood.

10. The cargo support using a wood polymer/plastic composite material as claimed in claim 1, wherein the compound is molded into the wood polymer/plastic composite material through any one of extrusion, injection or press molding.

* * * * *